United States Patent [19]

Hayashi

[11] 4,197,057

[45] Apr. 8, 1980

[54] FAN ASSEMBLY

[75] Inventor: Masaharu Hayashi, Toyota, Japan

[73] Assignee: Aisin Seiki Kabushiki Kaisha, Kariya, Japan

[21] Appl. No.: 897,215

[22] Filed: Apr. 17, 1978

Related U.S. Application Data

[63] Continuation-in-part of Ser. No. 750,320, Dec. 14, 1976, abandoned.

[30] Foreign Application Priority Data

Dec. 17, 1975 [JP] Japan ..... 50-170713

[51] Int. Cl.[2] ..... F04D 29/38

[52] U.S. Cl. ..... 416/242; 416/132 R; 416/235

[58] Field of Search ..... 416/242, 235, 132 R

[56] References Cited

U.S. PATENT DOCUMENTS

| | | | |
|---|---|---|---|
| 152,973 | 7/1874 | Cross | 416/242 X |
| 528,253 | 10/1894 | Jay | 416/242 X |
| 535,271 | 3/1895 | Armstrong | 416/242 |
| 1,161,926 | 11/1915 | Criqui | 416/186 X |
| 1,506,937 | 9/1924 | Miller | 416/242 X |
| 2,581,873 | 1/1952 | Morrison | 416/242 |
| 3,514,215 | 5/1970 | Williams | 416/242 |
| 3,584,969 | 6/1971 | Aiki et al. | 416/132 |
| 3,751,181 | 8/1973 | Hayashi | 416/132 |

FOREIGN PATENT DOCUMENTS

| | | | |
|---|---|---|---|
| 838253 | 5/1952 | Fed. Rep. of Germany | 416/242 |
| 973372 | 2/1951 | France | 416/242 |
| 449176 | 12/1974 | U.S.S.R. | 416/242 |

*Primary Examiner*—Everette A. Powell, Jr.

*Attorney, Agent, or Firm*—Sughrue, Rothwell, Mion, Zinn and Macpeak

[57] ABSTRACT

The fan assembly for a motor vehicle includes a plurality of radially extending blades each having a first rearwardly facing concave curvature extending along the entire length of the blade adjacent the leading edge and a forwardly facing concave curvature at the outer end of the blade adjacent the trailing edge to increase the cooling efficiency of the fan and decrease the noise produced during operation.

1 Claim, 10 Drawing Figures

FAN ASSEMBLY

This application is a continuation in-part application of application Ser. No. 750,320 filed Dec. 14, 1976, now abandoned.

BACKGROUND OF THE INVENTION

1. Field of Invention

The present invention is directed to a fan assembly more particularly to a cooling fan assembly for a motor vehicle.

2. Prior Art

Various prior art fan assemblies for motor vehicles have been proposed by which cooling air is drawn through a radiator core and passed over the engine of the vehicle. A fan assembly of this type is for example disclosed in the patent to Aiki et al U.S. Pat. No. 3,584,969 and assigned to the assignee of the present invention. Each blade of such a prior art fan assembly has a cross-sectional configuration wherein a curved center line of the blade as viewed in cross-section is defined by a radius of curvature the central point of which is positioned on the discharged side of the fan. This configuration may cause a whirl of air adjacent the trailing edge of the blade due to the arrangement of the engine block which resists the flow of cooling air. Therefore the cooling operating efficiency will be considerably reduced while the noise level will be increased.

SUMMARY OF THE INVENTION

It is therefore an object of the present invention to provide an improved fan assembly which obviates the various drawbacks mentioned above by increasing the cooling efficiency and decreasing the noise produced during the cooling operation.

The fan assembly according to the present invention includes a plurality of radially disposed fan blades each of which is provided with a rearwardly facing concave curvature extending the entire length of the blade adjacent the leading edge of the blade and a forwardly facing concave curvature at the outer end of the blade adjacent the trailing edge of the blade with the oppositely directing curvatures merging smoothly at the intermediate portion of the blade.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
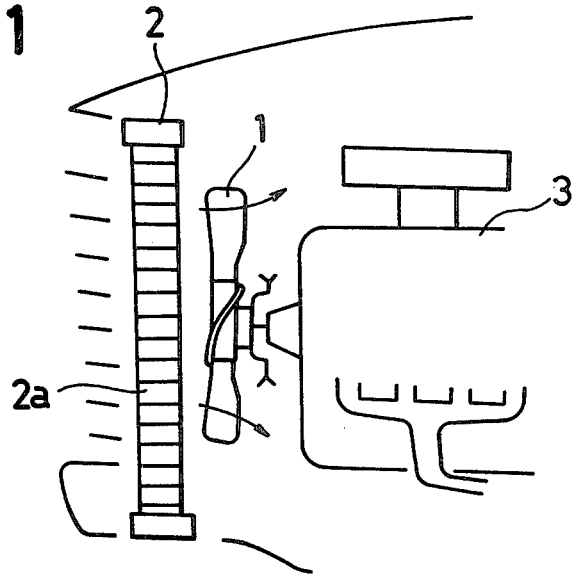
FIG. 1 is a schematic view showing the location of a fan assembly within the engine compartment of a vehicle between the radiator and the engine block.

Referring now to the drawings, a fan assembly 1 is mounted on the drive shaft of an engine 3 between the engine 3 and the radiator 2. Thus the fan assembly is adapted to draw cooling air through the radiator core 2*a* of the radiator 2 and to discharge the air around the engine 3.

Figure 2:
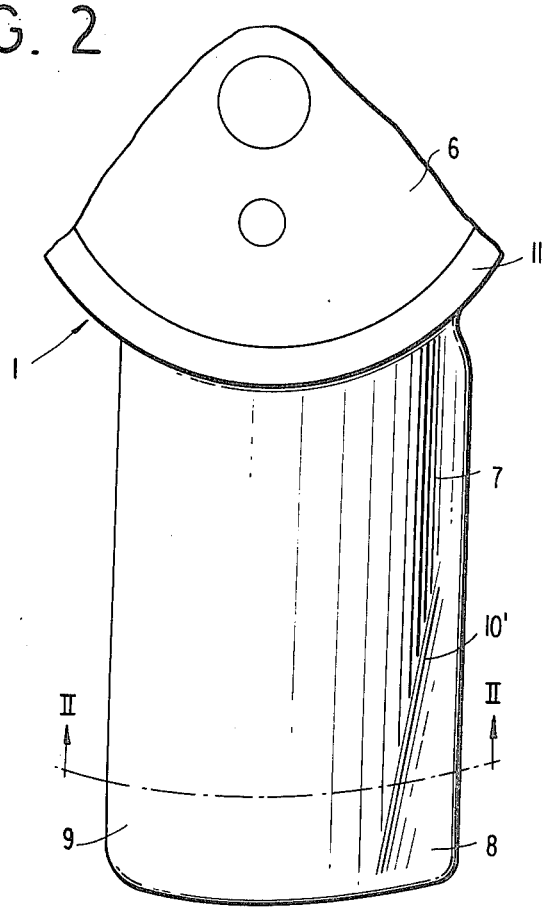
FIG. 2 is a partial front view of a fan assembly according to the present invention showing a single blade.
Figure 5:
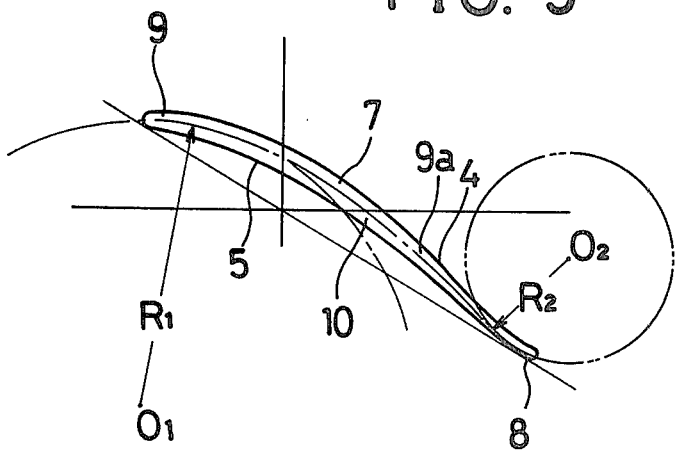
FIG. 5 is a view similar to FIG. 3 which more particularly shows the construction of the fan blade according to the present invention.

The fan assembly 1 includes a fan having a central boss 6, a peripheral annular flange 11 and a plurality of radially disposed blades 7, only one of which is illustrated in FIG. 2. The blades 7 which are integrally formed with the boss 6 and flange 11 may be formed of non-flexible material such as steel as well as from a flexible synthetic resin material. The trailing edge 8 of each curved blade 7 is provided with a reverse curvature toward the front surface 4 as shown in FIG. 5. More particularly the curved center line 9*a* of the blade 7 as viewed in cross-section is defined by two oppositely curved sections each having a different radius of curvature and an intermediate connecting section between the two oppositely curved sections. The center $O_2$ of the radius of curvature $R_2$ is located on the front side 4 of the blade 7 while the center $O_1$ of the radius of curvature $R_1$ is located on the rear side 5 of the blade 7. Thus the portion of the curved center line 9*a* adjacent the leading edge 9 of the blade 7 is defined by a curve having a radius $R_1$ while the portion of the curved center line 9*a* adjacent the trailing edge 8 of the blade 7 is defined by a curve having a radius $R_2$. The intermediate section of the curved center line 9*a* at the intermediate portion 10 of the blade 7 is comprised of a line having oppositely directed curves adjacent each end which merge smoothly with the curved portions of the center line 9*a* having the radii of curvature $R_1$ and $R_2$, respectively. The inflection line 10' between the two oppositely curved portions is shown in FIG. 2 at an acute angle to the radius of the blade. Thus the root portion of the blade 7 has only a single radius of curvature $R_1$ and the outer portion of the blade has opposite radii of curvature $R_1$ and $R_2$.

Figure 3:
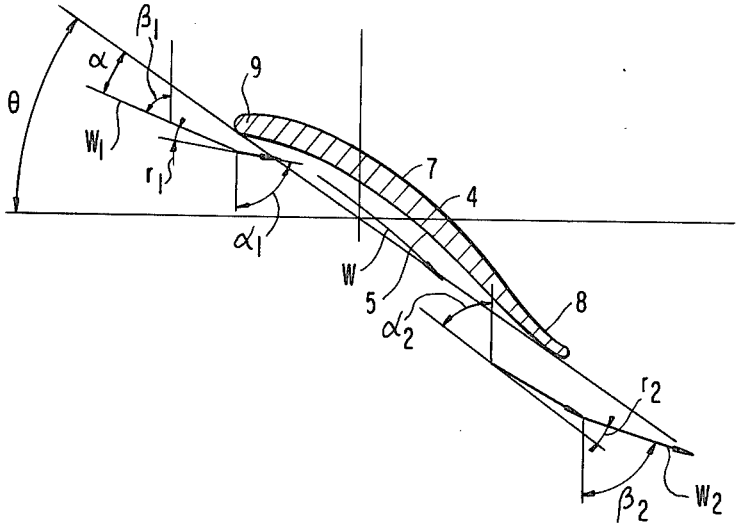
FIG. 3 is a cross-sectional view of the fan blade according to the present invention taken substantially along the line II—II in FIG. 2.

As shown in FIG. 3 the flow of air as indicated by the arrow W is curved due to the difference in pressure at the front and rear surfaces 4 and 5 of the blade 7. Thus the inflow and outflow angles $\alpha_1$ and $\alpha_2$ of air flow W will be different from flow angles $\beta_1$ and $\beta_2$ of air flows $W_1$ and $W_2$ to the leading edge 9 and from the trailing edge respectively by excess angles $\gamma_1$ and $\gamma_2$, respectively. Therefore the following equations can be written:

$$\gamma_1 = \Delta_1 - \beta_1$$

$$\alpha_2 = \beta_2 - \alpha_2$$

In FIG. 3 the angle of inclination of the blade 7 is designated $\theta$ and $\alpha$ is the angle of elevation of air flow. In order to reduce or prevent a whirl of air, especially around the trailing edge 8 of the blade 7 the curved center line 9*a* may be designed adjacent the air flows $W_1$ and $W_2$ taking into consideration the various above mentioned factors.

Figure 7:
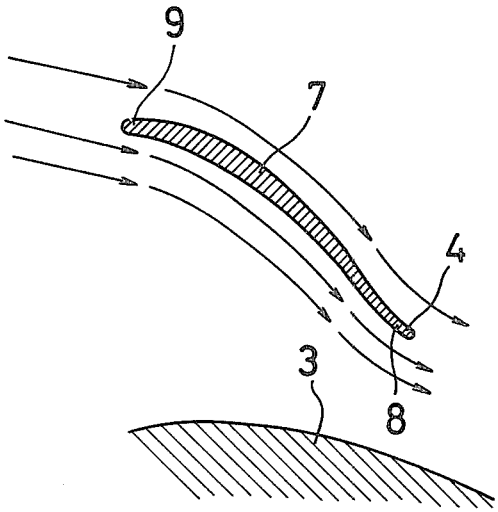
FIG. 7 is a view similar to FIG. 6 which schematically shows the flow of air according to the present invention.

By constructing the blade 7 with the trailing edge 8 thereof curving towards the front surface 4 the flow of air past the trailing edge of the blade will occur without any undesirable whirl of air as best seen in FIG. 7. The a ial flow of air which occurs upon rotation of the fan blades is centrifugally urged by means of the forwardly curved portion adjacent the trailing edge 8 of the blade 7 which acts as a centrifugal fan. Therefore the air flows diagonally due to the composition of axial and centrifugal components. This results in the increase in the dynamic component of air flow between the fan assembly and the engine 3 to thereby effect an increase in the cooling efficiency for the vehicle engine.

Figure 4:
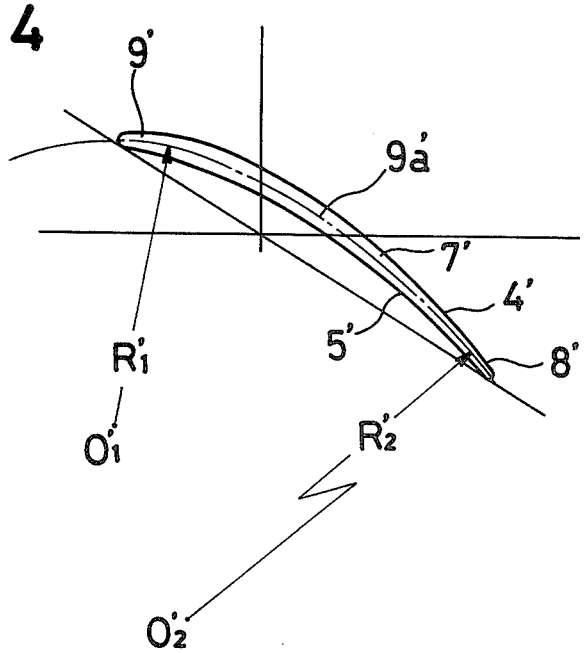
FIG. 4 is a view similar to FIG. 3 showing the cross-sectional configuration of a prior art fan blade.
Figure 6:
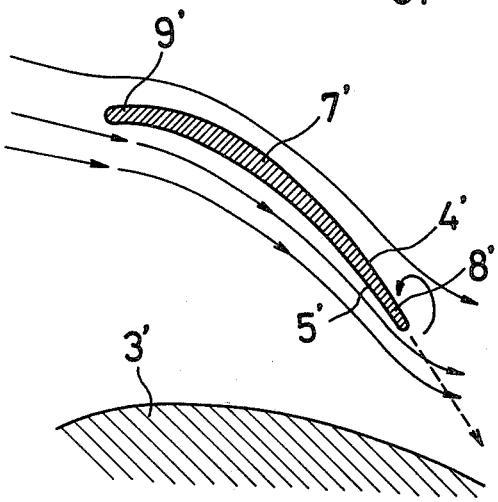
FIG. 6 is a view similar to FIG. 4 which schematically shows the flow of air according to a prior art fan assembly.

A conventional blade is illustrated in FIGS. 4 and 6 wherein the curved center line 9*a*′ of the blade 7′ is defined by curves having radii of curvature $R_1'$ and $R_2'$, the central points $O_1'$ and $O_2'$ of which are positioned at the same side of the rear surface 5′ of the blade 7′. The pressure at the rear surface 5′ of the blade 7′ increases due to the position of the engine 3′ which resists the flow of air in the axial direction. Therefore the flow of air is urged toward the front side of the blade 7′ so that a part of the air which flows past the edge 8′ will flow upstream toward the front surface 4′ so as to define a low pressure are around the front surface 4′ adjacent the trailing edge 8′. This results in a decrease in the quantity of air flowing around the engine 3′. By constructing the blades according to the present invention, this disadvantage will be reduced.

The advantages of the present invention will be more clearly understood from the following experimental data comparing a fan according to the present invention with a conventional fan.

| | Factor | Present Invention | Prior Art |
|---|---|---|---|
| Dimen- | Outside Diameter | | |

-continued

| | Factor | Present Invention | Prior Art |
|---|---|---|---|
| sions | Of Fan | 380 | 380 |
| Of Fan | Diameter Of Fan | | |
| Assem- | Boss | 166 | 166 |
| bly | Number Of | | |
| | Blades | 6 | 6 |
| | Width Of Blade | 108 mm | 108 mm |
| | Inclination Angle | | |
| | Of Blade | 30° | 30° |
| | $R_1$ ($R_1'$) | 440 mm | 440 mm |
| | $O_1$ ($O_1'$) | Side Of Rear | Side Of Rear |
| | | Surface Of Blade | Surface Of Blade |
| | $R_2$ ($R_2'$) | 260 mm | 340 mm |
| | $O_2$ ($O_2'$) | Side Of Front | Side Of Rear |
| Experi- | | Surface Of Blade | Surface Of Blade |
| mental | Fan Noise | 94.5 dB | 98.0 dB |
| Results | Fan Efficiency | 57% | 42% |

In the above table, noise was measured at a distance of one meter from the front of the fan assembly when the fan was running at 3,250 rpm and the fan efficiency was measured with the fan running at 1,000 rpm.

Figure 8:
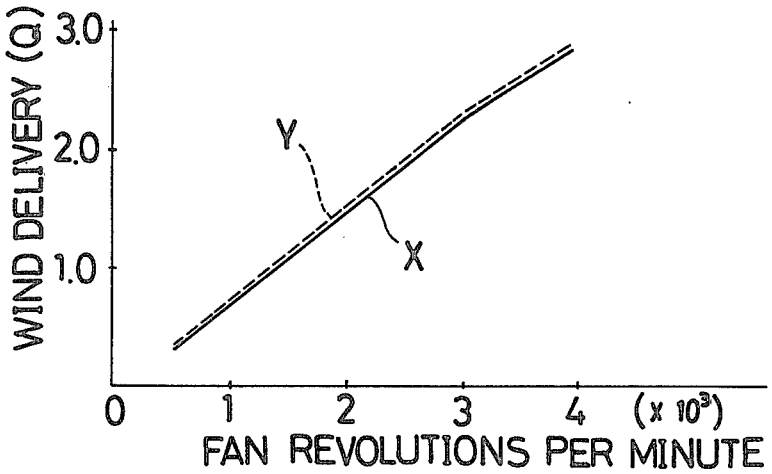
FIGS. 8, 9 and 10 are graphs showing comparative experimental curves for a fan according to the present invention and a conventional fan.
Figure 9:
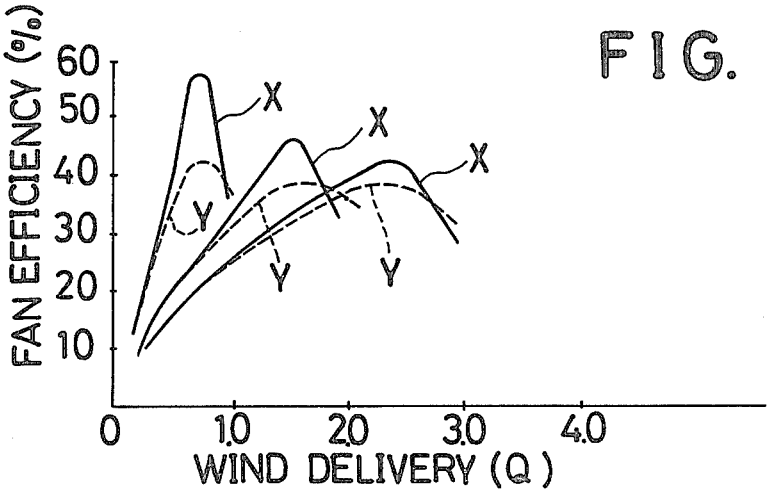
Figure 10:
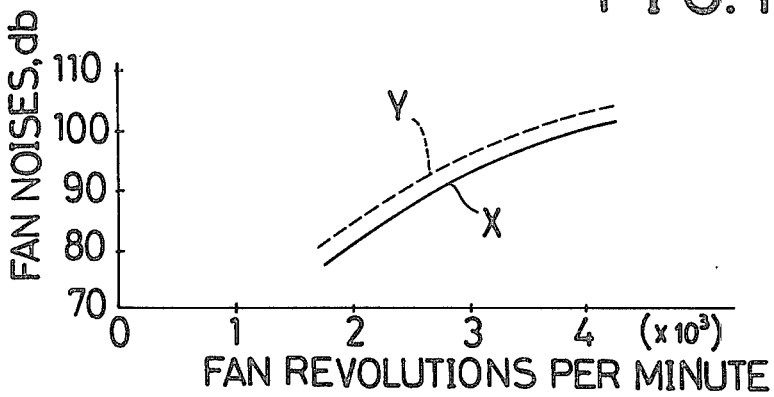

More particularly, the advantages of the fan assembly according to the present invention as compared to a conventional fan will be better understood from the graphical illustrations in FIGS. 8, 9 and 10.

What is claimed is:

1. A fan assembly comprising a central boss member and a plurality of non-overlapping blades connected to and extending straight radially outwardly from said boss member, each of said blades having an upstream side, a downstream side, a leading edge and a trailing edge said edges of the blade being disposed parallel to each other, the root portion of the blade having only a single radius of curvature located on the downstream side of said blade and the radially outer portion of the blade having a reversely curved portion adjacent the trailing edge of said blade with a radius of curvature positioned on the upstream side of said blade; the inflection line between said oppositely directed curvatures being disposed at an acute angle relative to the radius of said blade extending outwardly from said boss member and extending from a point adjacent the trailing edge of the blade at the midpoint thereof outwardly to the outer edge of the blade.

* * * * *